US006449880B1

(12) United States Patent
Calabrese et al.

(10) Patent No.: US 6,449,880 B1
(45) Date of Patent: Sep. 17, 2002

(54) ANTISLIP APPARATUS FOR FOOTWEAR

(76) Inventors: Antonino Calabrese, Via Monte Cervialto, 197/G, 00139 Roma (IT); Sergio Guizzardi, Via della Tecnica, 39, 40050 Argelato (BO) (IT)

( * ) Notice: Subject to any disclaimer, the term of this patent is extended or adjusted under 35 U.S.C. 154(b) by 0 days.

(21) Appl. No.: 09/703,800

(22) Filed: Nov. 1, 2000

(51) Int. Cl.[7] ..... A43C 15/06
(52) U.S. Cl. ..... 36/61; 36/67 R
(58) Field of Search ..... 36/61, 59 R, 134, 36/67 R

(56) References Cited

U.S. PATENT DOCUMENTS

| | | | | |
|---|---|---|---|---|
| 264,105 | A | * | 9/1882 | Rust |
| 1,179,652 | A | * | 4/1916 | Rightor |
| 1,232,896 | A | * | 7/1917 | Clifford |
| 1,487,976 | A | * | 3/1924 | Rossi et al. |
| 1,607,296 | A | * | 11/1926 | Noel |
| 3,747,238 | A | * | 7/1973 | Jankauskas |
| 5,870,838 | A | * | 2/1999 | Khayat |
| 5,956,870 | A | * | 9/1999 | Grossman et al. |

* cited by examiner

*Primary Examiner*—Ted Kavanaugh

(74) *Attorney, Agent, or Firm*—McGlew and Tuttle, P.C.

(57) ABSTRACT

An antislip apparatus is provided for footwear to be fit on a region of a sole and/or a heel of a shoe defining an engagement surface in contact with the ground surface. The antislip apparatus includes a ground gripping structure for engaging the ground surface including a support and crampon-like prongs disposed on the support extending perpendicularly from the support. A cam arrangement interacts with the support for moving the prongs to one of a grip position with the prongs extending beyond the level of the engagement surface, or to a rest position with the prongs disposed inwardly of the engagement surface. The cam arrangement includes a plate disposed substantially parallel to the support and cams acting on one of the support and the plate to vary a distance between the support and the plate to move the prongs. An operating arrangement or actuator is provided for operating the cam arrangement. The actuator includes a cylindrical rotor formed integral with the plate. The rotor is disposed perpendicularly to the support and has at a lower end thereof, accessible from a side of the engagement surface, a seat defined by a groove or cut. A holding box element contains the support, the cam arrangement and the actuator. The holding box element is provided one of below or on the engagement surface. The holding box element includes an opening allowing access to the actuator and has one or more slots which the prongs extend through in the grip position.

17 Claims, 3 Drawing Sheets

ANTISLIP APPARATUS FOR FOOTWEAR

FIELD OF THE INVENTION

The present invention relates to an antislip apparatus for footwear.

BACKGROUND OF THE INVENTION

It is known to be quite difficult to walk on surfaces having low coefficient of friction, such as frozen grounds, roadways and sidewalks.

To overcome this problem, the prior art has provided shoes with rubber soles with marked protrusions or engravings. Such shoes, although having a sufficient grip on fresh snow, do not provide a safe hold in case of frozen surfaces.

An alternative to this solution is represented by metal, crampon-like prongs to be applied to the shoes. This solution provides a good grip but results in a bulky structure and makes it necessary to add an accessory to the shoes which thus cannot be used as a shoe.

SUMMARY OF THE INVENTION

The object of the present invention is to provide an apparatus able to provide a sufficient grip on slippery grounds for footwear of a sport type as well as for footwear of traditional type for everyday use.

This result has been achieved, according to the invention, by providing an apparatus having prongs for engaging the ground surface, a cam means for moving the prongs between a grip position with the prongs extending beyond the level of an engagement surface and a rest position with the prongs disposed inwardly of the engagement surface and an actuator or operating means connected to the prong drive for operating the cam drive. The actuator has an actuating interface accessible from the engagement surface side of the antislip apparatus.

A support for the prongs may be provided. The cam drive may include a cam interacting with the support so as to vertically move the prongs. The support may comprise an annular body having slots as well as solid lengths located along a circular crown. The slots may be angularly correlated to the prongs, the prongs being disposed perpendicular to the support.

The cam drive may comprise a plate disposed substantially parallel to the support and being led with one or more cams to interact either with the slots or with the solid lengths so as to vary the distance between the support and the plate thereby moving the one or more prongs.

The cam drive may comprise a plate and the actuator may include a substantially cylindrical rotor integral with the plate and having the actuating interface at a lower end thereof comprising a seat defined by a groove or cut.

The cam drive may include a plate with a central square bore and the actuator may include a rotor with a corresponding square portion for a stable coupling with the plate.

The antislip apparatus preferably includes a box element, wherein the plate and the support are disposed inside the box element, the plate being located above the support. An elastic means may be provided for providing and elastic connection acting between the box element and the support, the elastic means imparts a thrust in a direction opposite to the action exerted by the one or more cams on the support upon interaction by the one or more cams with the solid lengths. A cover may be provided closing the box element and having a pin on a lower face of the cover. The pin may be inwardly of the apparatus, the plate being rotatable relative to the cover and exhibiting a curved slot inside which the pin is inserted to define an extent of travel of angular displacement corresponding to a preset rotation of the cover with respect to the plate. The plate may include a central square bore and the rotor may include a corresponding square portion for a stable coupling with the plate.

The support may be made up of an annular, substantially flat body. The prongs may be arranged as angularly equidistant prongs extending perpendicularly from the flat body along a circular crown, saw slots may be connected between the prongs through flaring ramps.

The advantages of the present invention lie in that the antislip apparatus provides a suitable grip on the ground and is fully integrated with the shoe. The apparatus is undetectable by anyone looking at the shoe so that it can be used on traditional and/or elegant footwear. The apparatus is disposed as a box-like element so that it can be easily and quickly associated to the shoe and for this reason allows also a mass production for great number of shoes. The apparatus can be very well integrated in the shoe, without any part protruding from the shoe (in non-operative condition of the apparatus) and without any part able to damage itself and other objects. The apparatus is of simple and ready utilization; exhibits a robust structure and is able to maintain its features also after a prolonged wear. Another advantage lies in that it is possible to manufacture (and to mass-produce) heels (and/or soles) containing the antislip apparatus and the antislip apparatus is able to be utilized in the manufacture of shoes of sport type as well as shoe of a traditional type for everyday use, without modifying the structure of the shoes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2A:
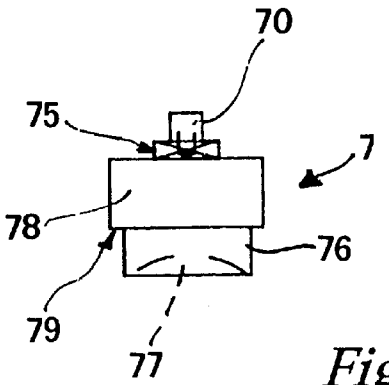
FIG. 2*a* is a side view of a detail of the embodiment shown in FIGS. 1*a* and 1*b*, relating to an operating rotor element.
Figure 2B:
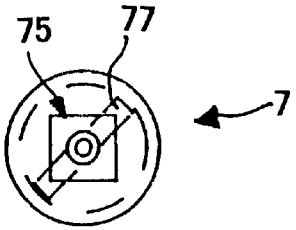
FIG. 2*b* is a top view of a detail of the embodiment shown in FIGS. 1*a* and 1*b*, relating to an operating rotor element.

Referring to the drawings in particular, an apparatus constructed according to the present invention and designated by 1 in its entirety. The footwear article is a footwear or shoe part defining an engagement surface for contact with the ground surface. The apparatus 1 can be associated to a footwear article at a region thereof which faces the lower surface or engagement surface in contact with the ground. In this embodiment, the apparatus 1 is fitted on a heel of a traditional shoe for men. The lower surface or or engagement surface of the same shoe is indicated by 20. The apparatus may also be associated with other types of footwear such as sport shoes, mountaineering boots, ski-boots, woman shoes, etc.

In the illustrated example, the apparatus 1 comprises a box-like or box holding element 3 closed by a cover 4. The box holding element 3 has a substantially cylindrical, upwardly open shape on a base 30 of which there are provided a central through hole 39 and four through slots 38 disposed angularly equidistant.

The cover 4 is of circular shape and exhibits a central through hole 40 and a pin 49 which protrudes from the lower face 48, the latter remaining inside when the cover 4 closes the box element 3 upon the assembly of the apparatus.

Provided inside the box element and inwardly of the cover 4 is a prong support 5, a cam means with a drive plate 6, an activation rotor 7 and a spring 8.

Figure 6A:
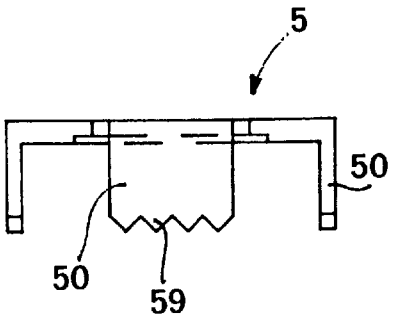
FIG. 6*a* is a side view of a detail of the embodiment illustrated in FIGS. 1*a* and 1*b*, relating to a support for prongs.
Figure 6B:
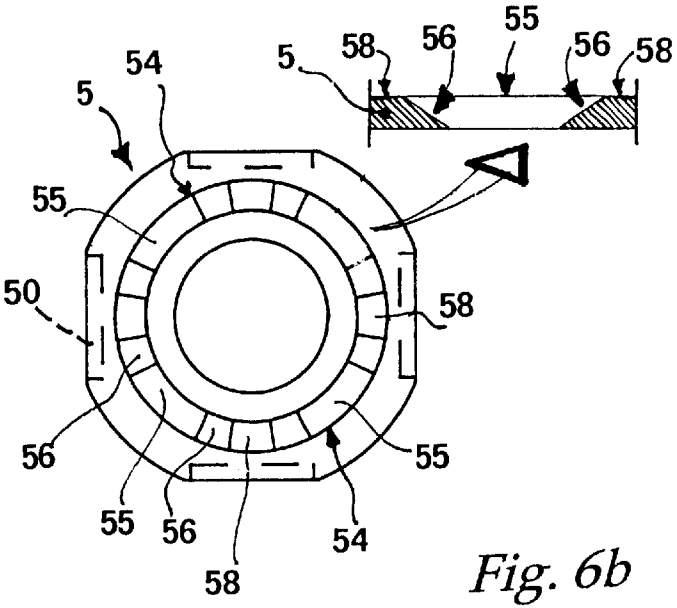
FIG. 6*b* is a top view illustrating also a detail in sectional view relating to the shape of a slot.
Figure 5B:
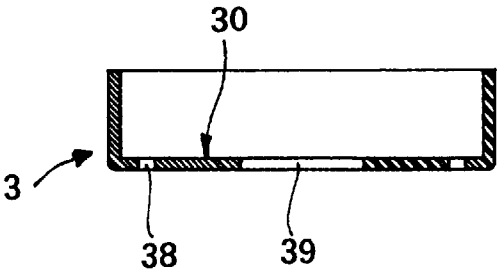
FIG. 5*b* is a sectioned view taken on line V—V in FIG. 5*a*, of a detail of the embodiment illustrated in FIGS. 1*a* and 1*b*, relating to a box element.
Figure 5A:
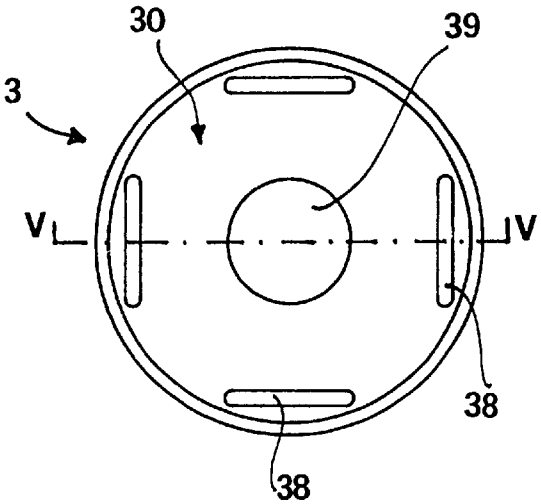
FIG. 5*a* is a top view of a detail of the embodiment illustrated in FIGS. 1*a* and 1*b*, relating to a box element.

The prong support 5 defines part of a ground gripping means for gripping the ground. In the illustrated example, ground gripping means includes an annular, substantially flat body from which four angularly equidistant prongs 50 protrude orthogonally (that is, disposed at 90° to each other). The prongs 50 are made up of laminate having serrated free ends 59 with such longitudinal development and thickness allowing them to be introduced into straight slots 38 of the box element 3 previously described. The support 5 for the prongs is also provided with four slots having a curved development 55 and disposed angularly equidistant along a circular crown 54. In particular, the four slots 55 are offset by 45° to the prongs 50 and are separated by solid lengths 58. Possibly provided between the solid lengths 58 and the slots 55 are flaring ramps 56 likewise those more clearly visible in the enlarged sectional view of the detail in FIG. 6*b*. The flaring ramps 56 are provided in pairs on the sides of each slot 55 and exhibit a profile extending towards the side of the adjacent solid length 58.

The driving plate 6 is circular in shape and has a square through hole 60 in the middle, and a slot 65 develops along an arc under a preset angle and around the central hole 60 at a distance from the center corresponding to the spacing between the central hole 40 of cover 4 and the pin 49 provided on the cover 40. The width of the slot 65 is such as to allow the insertion of the pin 49 into the slot 65. Also provided on the lower side 69 of plate 6 are four cams 61 having an arcuate convex profile and forming part of the cam means.

An actuator or operating means including an operating rotor 7 is made up of a substantially cylindrical body with different sections along its height. In its upper end, the rotor 7 has a cylindrical portion 70 of such a diameter as to be insertable into the central hole 40 of cover 4. Under the cylindrical portion 70, the rotor 7 exhibits a square portion 75 which can be inserted into the square hole 60 of the driving plate 6 so as to be fixed to the latter during the rotational movement. Provided below the square portion 75 are a central portion 78 of larger cross-section and a lower portion 76 of a diameter corresponding to that of the central hole 39 provided on the box element 3. The lower portion 76 has an engagement surface or seat 77 at its free end, which seat is defined by a groove or cut disposed diametrally with respect to the rotor 7. The seat 77 is accessible through the central hole 39 when the apparatus is assembled.

Figure 1A:
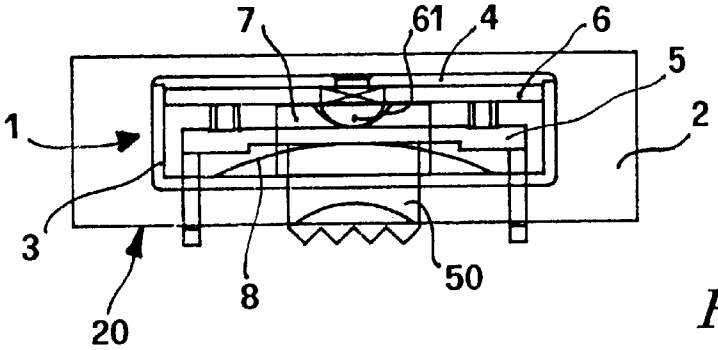
FIG. 1*a* is a front view showing an embodiment of the invention associated to a heel of a footwear article with cutaway parts to show other parts more clearly.
Figure 1B:
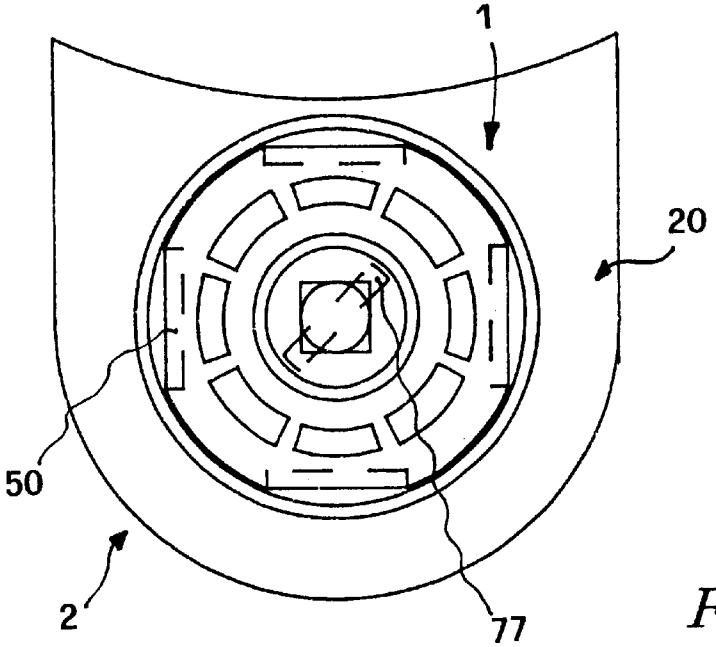
FIG. 1*b* is a plan view showing an embodiment of the invention associated to a heel of a footwear article with cutaway parts to show other parts more clearly.
Figure 4A:
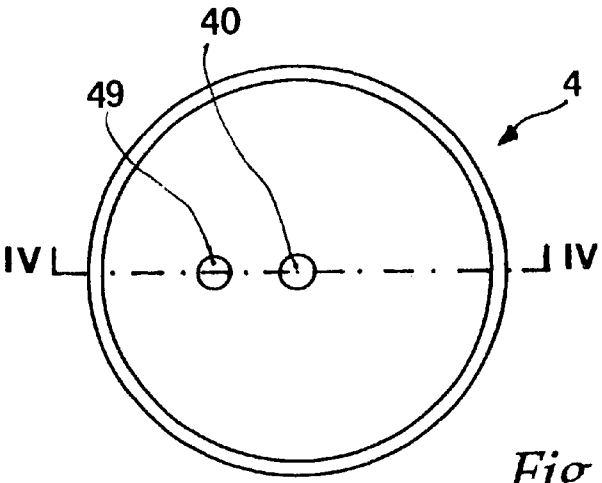
FIG. 4*a* is a top view of a detail of the embodiment illustrated in FIGS. 1*a* and 1*b*, relating to a cover.
Figure 4B:
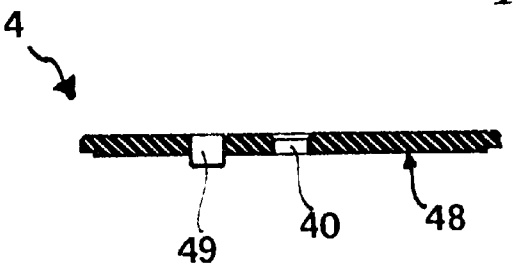
FIG. 4*b* is sectioned view taken on line IV—IV in FIG. 4*a*, of a detail of the embodiment illustrated in FIGS. 1*a* and 1*b*, relating to a cover.
Figure 3B:
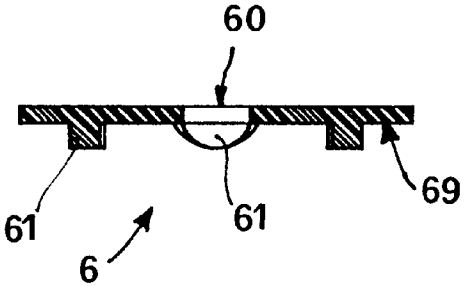
FIG. 3*b* is a sectioned view taken on line III—III in FIG. 3*a*, of a detail of the embodiment illustrated in FIGS. 1*a* and 1*b*, relating to a driving plate.
Figure 3A:
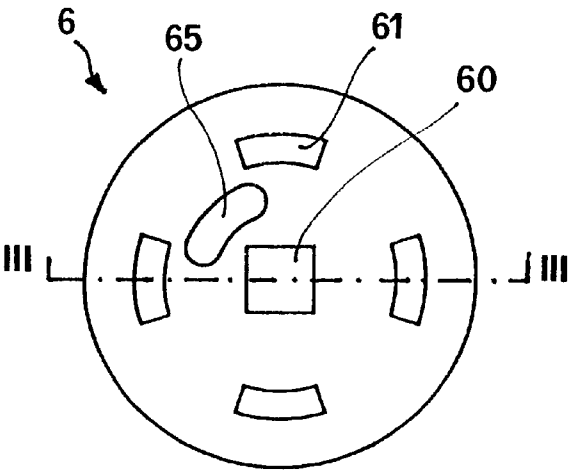
FIG. 3*a* is a top view a sectioned view on line III—III in FIG. 3*a*, of a detail of the embodiment illustrated in FIGS. 1*a* and 1*b*, relating to a driving plate.

Once assembled, the apparatus 1 may have the configuration shown in FIGS. 1*a* and 1*b*. In practice, the box element 3 is closed on top by the cover 4 which has its pin 49 extending downwards. Disposed just below the cover 4 is the driving plate 6 into the slot is 65 of which the pin 49 goes through, while the square portion 75 of rotor 7, disposed centrally in the apparatus 1, goes through the square hole 60 thereof. The cam means with plate 6 has its cams 61 facing downwards and resting on the support 5, the latter being urged upwards by the spring 8 which is made to act between the inner face of the box element 3 and the same support 5.

The prongs 50 of support 5 are disposed in correspondence of straight slots 38 of the box element 3 and are able to come out thereof when the apparatus 1 is in an operative condition, that is, with the prongs 50 in a gripping position.

As previously mentioned, the rotor 7 is disposed centrally, solid or fixed with the plate 6, and its portions interact with the other structural components of the apparatus 1 as described later on. The upper cylindrical portion 70 is inserted into the central hole 40 of the cover 4. The central portion 78 is disposed inwardly of the prongs support 5, it is not solid with the latter, and the periphery of its lower face 79 is in contact with the upper (inner) face of the cover 3, so that it can rotate relative to the latter. Finally, the lower portion 76 has the seat 77 turned downwards so as to allow the rotor 7 to be rotated with ease by means of a coin or a screwdriver or the like.

By rotating the seat 77 and thus the whole rotor 7, the rotor 7 drives into rotation the driving plate 6 solid thereto. The rotation of the plate 6 causes the cams 61 to slide along the crown 54 defined by the sequence of slots 55 and solid lengths 58 of the support 5. When the cams 61 are inserted into the slots 55, the apparatus 1 is closed and the prongs 50 do not protrude from the lower surface of the shoe because the spring forming elastic means urge the support 5 upwards. When, on the other hand, the cams 61 interact with the solid lengths 58, the support 5 is urged downwards and the prongs 50 result in a gripping condition, as shown in FIG. 1*a*. The return of prongs 50 to the retracted or rest position is caused by the spring 8 urging the support 5 upwards, as the latter is no longer subject to the downwardly directed action of the cams 61.

The movement between the solid lengths 58 and the slots 55 of the crown 54 is made smother in both directions by the presence of the flaring ramps 56 previously described.

The rotation of the rotor 7 and of plate 6 fixed thereto is limited by the extension of the curved slot 65 of plate 6 within which the pin 49 of cover 4 is made to slide.

The association of the apparatus 1 to the footwear article maybe made in various ways. In fact, it is possible either to mount the apparatus 1 inside the heel when manufacturing the shoe, or to provide a heel having the apparatus already inside it and associate the heel to the shoe afterwards. It is possible to manufacture heels or soles provided with the apparatus. In the case of ski-boots or shoes with plastics or rubber soles, it is possible to embed the apparatus 1 within a portion of the sole. For example, reference is made to what is illustrated in FIG. 1*a*. The structure 1 is provided inside the heel 2 and, on the lower surface 20 thereof. Slots are provided allowing the passage of prongs 50 in case of activation of the latter. In any case, a shoe will be obtained which, when looking at it laterally or from above, will not exhibit any aesthetical differences to a corresponding shoe not equipped with the apparatus and will not present any part protruding from the shoe (in a non-operative condition of the apparatus).

While specific embodiments of the invention have been shown and described in detail to illustrate the application of the principles of the invention, it will be understood that the invention may be embodied otherwise without departing from such principles.

What is claimed is:

1. An antislip apparatus for footwear to be fit on a region of a sole and/or a heel of a shoe defining an engagement surface in contact with the ground surface, the antislip apparatus comprising:

ground gripping means for engaging the ground surface, said gripping means including a support and crampon-like prongs disposed on said support extending perpendicularly from said support;

cam means interacting with said support for moving said prongs to one of a grip position with said prongs extending beyond the level of the engagement surface or to a rest position with said prongs disposed inwardly of the engagement surface, said cam means comprising a plate disposed substantially parallel to said support and cams acting on one of said support and said plate to vary a distance between said support and said plate to move said prongs; and operating means for operating said cam means, said operating means comprising a cylindrical rotor formed integral with said plate, said rotor being disposed perpendicularly to said support and having at a lower end thereof, accessible from a side of the engagement surface, a seat defined by a groove or cut; and a holding box element containing the support, said cam means and said operating means, said holding box element being provided relative to the engagement surface, said holding box element including an opening allowing access to said operating means and having one or more slots which said prongs extend through in said grip position.

2. An apparatus according to claim 1, wherein said support comprises an annular body having one or more annular body slots as well as one or more solid lengths located along a circular crown, said annular body slots being angularly correlated to a position of said prongs.

3. An apparatus according to claim 2, further comprising:

elastic means for applying a biasing force, wherein said plate and said support are disposed inside said box element, with said plate being located above said support, said elastic means being provided acting between said box element and said support to impart a biasing force in a direction opposite to an action exerted by said cam means on said support upon their interaction with said solid lengths.

4. An apparatus according to claim 3, wherein said support comprises a substantially flat body from which said prongs extend perpendicularly at angularly equidistant locations, and on which, said body including a circular crown with slots and solid lengths is connected between said slots via flaring ramps.

5. An apparatus according to claim 1, further comprising a cover closing said box element with a pin on a lower face and inwardly of said cover, said plate being able to rotate relative to said cover and said plate having a curved slot inside which said pin is inserted to define a travel of such angular displacement corresponding to a preset rotation of said cover with respect to said plate.

6. An apparatus according to claim 5, wherein said plate includes a central square bore and said rotor includes a corresponding square portion for a stable coupling with said plate.

7. An apparatus according to claim 6, wherein said rotor is made up of a substantially cylindrical body provided with a cylindrical portion located above said square portion and having a diameter for insertion of said cylindrical portion into a central hole of said cover, and said cylindrical body having a central portion of larger cross-section and a lower portion having a diameter corresponding to a central hole formed on said box element, said lower portion having said seat.

8. An antislip apparatus and a shoe part combination, the combination comprising:

a footwear part defining an engagement surface for contact with the ground surface; and an antislip apparatus including prongs for engaging the ground surface, a cam drive for moving the prongs between a grip position with the prongs extending perpendicular to the engagement surface and extending beyond the level of the engagement surface and a rest position with the prongs disposed perpendicular to the engagement surface and disposed inwardly of the engagement surface and an actuator connected to said cam drive for operating the cam drive, said actuator having an actuating interface accessible from the engagement surface side of the antislip apparatus.

9. A combination according to claim 8, wherein said antislip apparatus further comprises a support for said prongs and said cam drive comprises a cam drive interacting with said support so as to vertically move said prongs.

10. A combination according to claim 8, wherein said antislip apparatus further comprises a support for said prongs, said support comprising an annular body having slots as well as solid lengths located along a circular crown, said slots being angularly correlated to said prongs, said prongs being disposed perpendicular to said support, said cam drive comprising a plate disposed substantially parallel to said support and being led with one or more cams to interact either with said slots or with said solid lengths so as to vary the distance between said support and said plate thereby moving said one or more prongs.

11. A combination according to claim 10, wherein said cam drive comprises a plate and said actuator includes a substantially cylindrical rotor integral with said plate and having said actuating interface at a lower end thereof comprising a seat defined by a groove or cut.

12. A combination according to claim 10, wherein said antislip apparatus further comprises:

a box element, wherein said plate and said support are disposed inside said box element, said plate being located above said support; and elastic means for providing and elastic connection acting between said box element and said support, said elastic means imparting a thrust in a direction opposite to the action exerted by said one or more cams on said support upon interaction by said one or more cams with said solid lengths.

13. A combination according to claim 10, wherein said antislip apparatus further comprises:

a box element, wherein said plate and said support are disposed inside said box element, said plate being located above said support;

a cover closing said box element and having a pin on a lower face of said cover, said pin being inwardly of the apparatus, said plate being rotatable relative to said cover and exhibiting a curved slot inside which said pin is inserted to define an extent of travel of angular displacement corresponding to a preset rotation of the cover with respect to the plate.

14. A combination according to claim 10, wherein said plate includes a central square bore and said rotor includes a corresponding square portion for a stable coupling with said plate.

15. A combination according to claim 10, wherein said support is made up of an annular, substantially flat body, said prongs being arranged as angularly equidistant prongs extending perpendicularly from said flat body along a circular crown, saw slots being connected between said prongs through flaring ramps.

16. A combination according to claim 8, wherein said cam drive comprises a plate including a central square bore and said actuator comprises a rotor with a corresponding square portion for a stable coupling with said plate.

17. A combination according to claim 16, wherein said antislip apparatus further comprises:

a box element, wherein said plate and said support are disposed inside said box element, said plate being located above said support;

a cover closing said box element, wherein a cylindrical portion is located above said square portion and has a diameter suitable for insertion thereof into a central hole of said cover, and with a central portion of larger cross-section and a lower portion, said lower portion having a diameter corresponding to a central hole formed on said box element and being provided with an actuating interface.

* * * * *